US007475618B1

(12) United States Patent
Pardue et al.

(10) Patent No.: US 7,475,618 B1
(45) Date of Patent: Jan. 13, 2009

(54) SCREW GUN EXTENSION AND SCREW KEEPER

(76) Inventors: Darren Scott Pardue, 2836 State Hwy. 19, Stratford, OK (US) 74872; Donald D. Southwell, 2816 Raintree Cir., Norman, OK (US) 73072-7413

( * ) Notice: Subject to any disclaimer, the term of this patent is extended or adjusted under 35 U.S.C. 154(b) by 0 days.

(21) Appl. No.: 11/974,607

(22) Filed: Oct. 15, 2007

(51) Int. Cl.
*B25B 23/10* (2006.01)

(52) U.S. Cl. ..... 81/451; 81/180.1

(58) Field of Classification Search ..... 81/451, 81/452, 436, 458, 456, 180.1
See application file for complete search history.

(56) References Cited

U.S. PATENT DOCUMENTS

| | | | | | |
|---|---|---|---|---|---|
| 1,417,995 | A | * | 5/1922 | Hilton | 81/452 |
| 1,977,323 | A | * | 10/1934 | Morgan | 81/458 |
| 2,310,287 | A | * | 2/1943 | Hausbeck | 81/452 |
| 2,632,488 | A | * | 3/1953 | Becker | 81/452 |
| 2,641,290 | A | * | 6/1953 | Webb | 81/451 |
| 2,829,685 | A | | 4/1958 | Mitchell | |
| 2,960,131 | A | * | 11/1960 | Clark | 81/456 |
| 4,934,717 | A | | 6/1990 | Budelman | |
| 5,207,127 | A | * | 5/1993 | Nick | 81/451 |
| 5,408,903 | A | | 4/1995 | Ramin | |
| 5,899,644 | A | | 5/1999 | Buck | |
| 5,992,274 | A | | 11/1999 | Lammers | |
| 6,601,478 | B1 | | 8/2003 | Hanson | |
| 6,668,941 | B2 | | 12/2003 | Phillips | |
| 6,676,001 | B1 | | 1/2004 | Chen | |
| 7,174,615 | B2 | | 2/2007 | Mark | |

* cited by examiner

*Primary Examiner*—Hadi Shakeri
(74) *Attorney, Agent, or Firm*—Randal D. Homburg

(57) ABSTRACT

An extension device attached to a screw gun providing for an extension of the driver tip of the screw gun and retaining a screw at a flexible end of the extension device holds a screw in a position for insertion into a surface of an object with the flexible end bending away from the driving pathway as the screw is inserted into the object, providing for the ability to insert and drive a screw into the object with a single hand from an extended distance from the object.

4 Claims, 3 Drawing Sheets

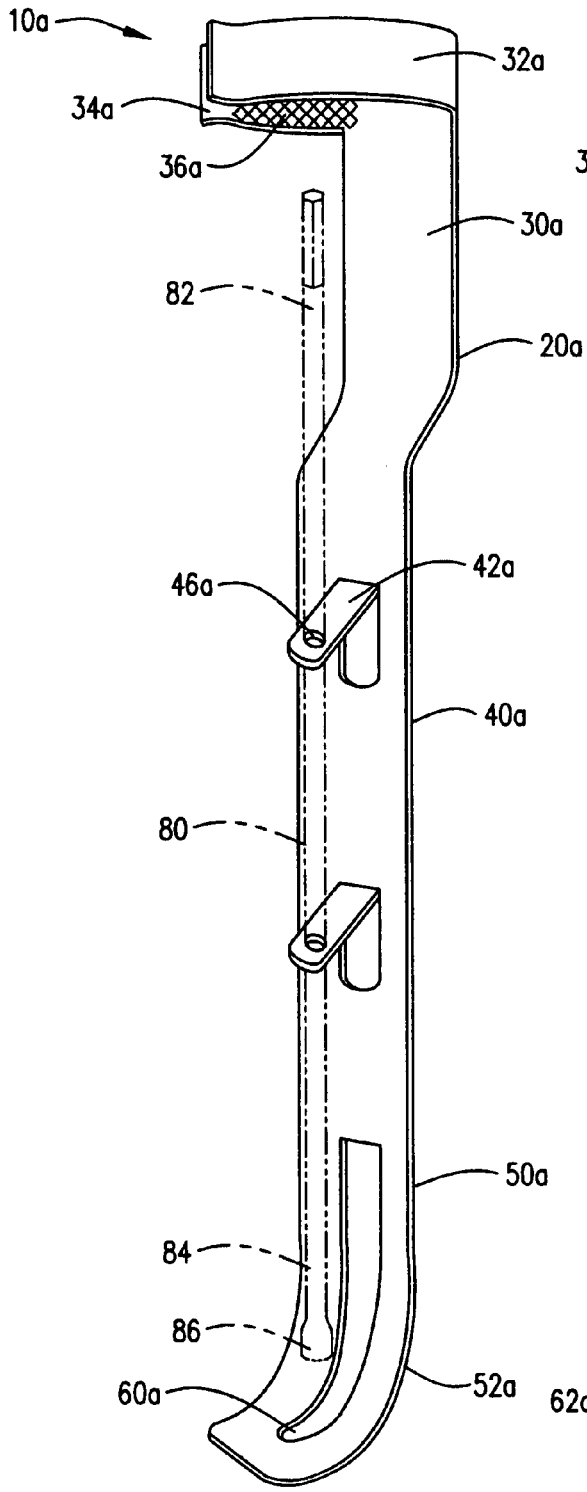
FIG. 5
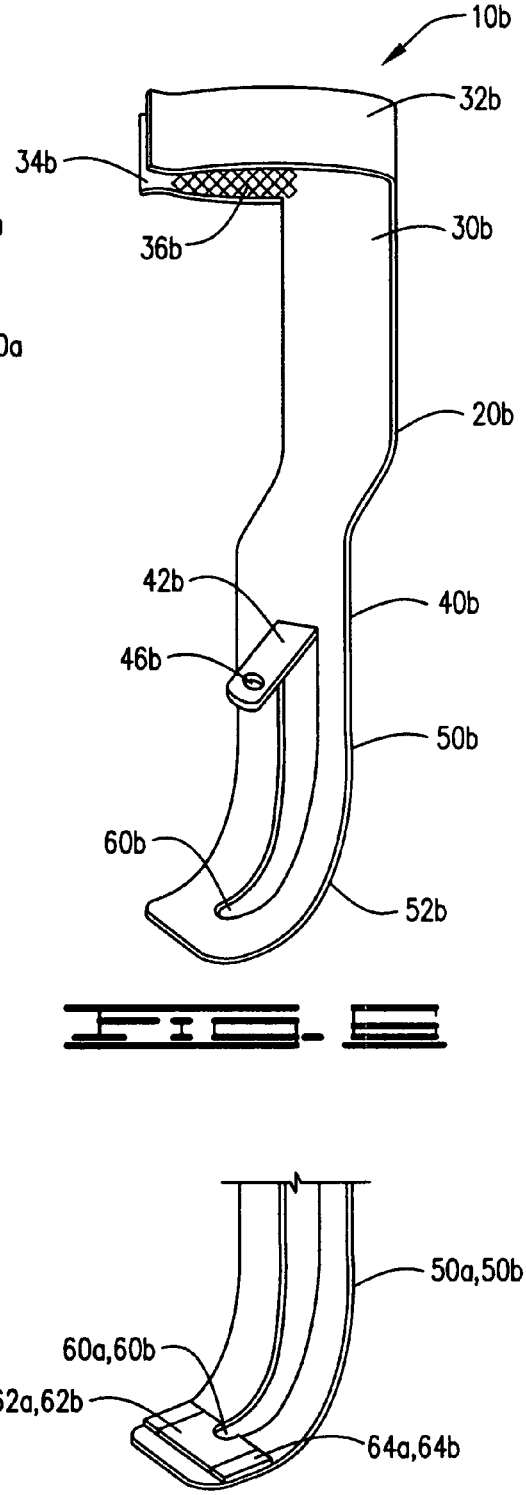
FIG. 6
FIG. 7

SCREW GUN EXTENSION AND SCREW KEEPER

CROSS REFERENCE TO RELATED APPLICATIONS

None

I. BACKGROUND OF THE INVENTION

1. Field of Invention

An extension device attached to a screw gun providing for an extension of the driver tip of the screw gun and retaining a screw at a flexible end of the extension device holds a screw in a position for insertion into a surface of an object with the flexible end bending away from the driving pathway as the screw is inserted into the object, providing for the ability to insert and drive a screw into the object with a single hand from an extended distance from the object.

2. Description of Prior Art

The following United States patents were discovered and are disclosed within this application for utility patent. All relate to screw gun extensions. For purposes of the application, screw gun is synonymous with a rotary drill, with or without an electrical extension cord, including a rotary drill powered by air, battery or electricity.

In U.S. Pat. No. 6,668,941 to Phillips, a screw holding and driving device is disclosed, attaching to a screw gun or power drill providing a drive tube within which a screw is inserted, en extension body and a drive assembly which is retained by the drill tip of the screw gun. This patent also discloses a depth adjuster, a bit storage caddy and features the guide tube to accept screws loaded within the guide tube through a top opening into the guide tube.

A guide tube for screw and plate assemblies, disclosed in U.S. Pat. No. 5,992,274 to Lammers, includes magnetic area within a plastic nose to pick up a screw and plate assembly by the head and install the fastener, the tube having a hollow extension body having a upper and lower end, a nose piece having magnets extending from the hollow extension body, a drive having an upper end and a lower end, the nose piece attached to the lower end, with a driver located within the hollow extension body accepting the head portion of the screw and plate, the driver engaging the head and inserting the screw and plate assembly within an object. Similar devices are also disclosed in U.S. Pat. Nos. 5,408,903 to Ramin, 2,829,685 to Mitchell and 7,174,615 to Mark.

A screw gun extension for the insertion of multiple screws provided by a belt containing multiple screws, is actually a screw positioning device, or keeper, which includes a tubular member having a coupling end adapted to be connected to a slidable barrel part for movement relative to a screw, and discharge end and a screw guiding chamber and two biased screw holding units for grasping the shaft of the screw to hold the screw while it is being inserted by the attached screw gun.

In all the above units, the insertion of the screw is linear as is the collapse of any portion of the patented devices. None of the above units provide a flexible end which retains a screw in an insertion position and flexibly bends laterally out of the way of the screw being driven and then returns to a pre-insertion position. In addition, the above devices do not disclose a bracket on their respective devices which grasp the screw gun body to retain the extension and screw keeper device, nor do they contain an intermediary portion, in an embodiment having at least one descending bracket having a central bore within which a drill rod is rotatably retained, the drill rod rotating within the central bore, the drill rod being attached to the screw gun at a first end with the drill rod having a screw head driver at a second end, wherein a head of the screw is placed within the screw head driver with the threaded shaft of the screw placed within the screw keeper, as disclosed in the present screw gun extension and screw keeper and as disclosed in the attached drawings.

II. SUMMARY OF THE INVENTION

Powered screw guns are commonly used to drive screws into a variety of surfaces, including wood, sheet metal, concrete and brick. For close or common and ordinary use, the screw guns simply employ a driver tip retained within the end of the screw gun and secured by either an external ring in modern screw guns or a chuck in some older or more powerful commercial models. The screws may be directly driven by the screw gun, and the user generally uses one hand to operate the screw gun trigger while holding the screw in an insertion position within another hand.

As seen in the prior art, some extension may be gained by what is generally comprised of a hollow tube with a screw driver tip located within the hollow tube, with a base end of the hollow tube captured and retained within the collapsible tip of the screw gun. These devices serve two purposes. First, they extend the tip of the screw gun to some extent. Second, they allow the user to insert the screw within the hollow tube and force the screw into the object being drilled without having to hold the screw with a second hand. They also provide lateral stability to the screw and some even provide for a depth control to prevent insertion of the screw below the surface of the object within which the screw is inserted.

The present extension and screw keeper device is provided for a somewhat different application, where a large number of screws are to be inserted into an object which is either far below the normal arm length of the person inserting the screws, predominantly into a roof surface upon which the user is standing or a location quite a distance, like a ceiling, above the head of the user where it would be difficult to complete the insertion of the screw using two hands without bending over repeatedly or having to stand on a stool. A shorter embodiment of the extension and screw keeper is also provided.

Some of the prior art discloses devices that might be enlarged from their respective embodiments to lengths that would prevent bending over to insert a screw into a roof or to insert a screw into a ceiling without having to stand on a stool, but the weight of these devices in the enlarged embodiments would be quite heavy and pose a serious stain on the hands, arms and shoulders of the users.

As disclosed, a first embodiment of the present extension and screw keeper is a rigid planar platform having a resilient clamp member on a first end attaching to the body of the screw gun, an intermediary portion having at least one descending bracket and a second end defining a screw keeper. A drill rod, retained by the at least one descending bracket, has a first end attached within the compressible screw gun tip of the screw gun, which normally retains a drill bit or a driver bit, affixing the first end of the drill rod within the drill. The second end of the platform provides a keeper which secures the threaded portion of the screw, while the second end of the drill rod engages the head of the screw. The second end of the otherwise rigid platform has a flexible curved portion that subsequent to the initial insertion of the screw, bends out of the way of the screw and the drill rod as the screw insertion is completed, returning to its unbent original position for insertion of the next screw.

A second embodiment of the extension and screw keeper has the intermediary portion, but lacks the drill rod. It still provides a short extension with a screw keeper and the same second end which has the curved portion which flexibly bends out of the way of the screw path during insertion of the screw. A simple and common screw driver tip is inserted into the compressible screw gun tip of the screw gun with the second embodiment having a stabilizing descending bracket which inserts over the compressible screw gun tip to provide a second stabilizing contact point between the screw gun and the extension and screw keeper.

The primary objective of the screw gun extension and screw keeper is to provide the screw gun with an extension which provides for single hand insertion of a screw from an extended distance, preventing the need for bending over to insert a screw located near the feet of the user or high above the head of a user. As secondary objective is to provide the extension and screw keeper in a light-weight embodiment with the minimal frame components which is strong and yet flexible enough to bend so as not to impede the insertion of the screw into the surface, while returning to its original position for the insertion of a subsequent screw into the surface.

III. DESCRIPTION OF THE DRAWINGS

The following drawings are submitted with this utility patent application.

FIG. 5 is a perspective view of the first embodiment of the extension and screw keeper with phantom lines indicating the drill rod.

FIG. 6 is a perspective view of the second embodiment of the extension and screw keeper.

FIG. 7 is a view of the screw keeper showing the removable section held secure within a frame section on the second end of the platform, a disclosed in both the first and second embodiments of the extension and screw keeper.

IV. DESCRIPTION OF THE PREFERRED EMBODIMENT

Figure 1:
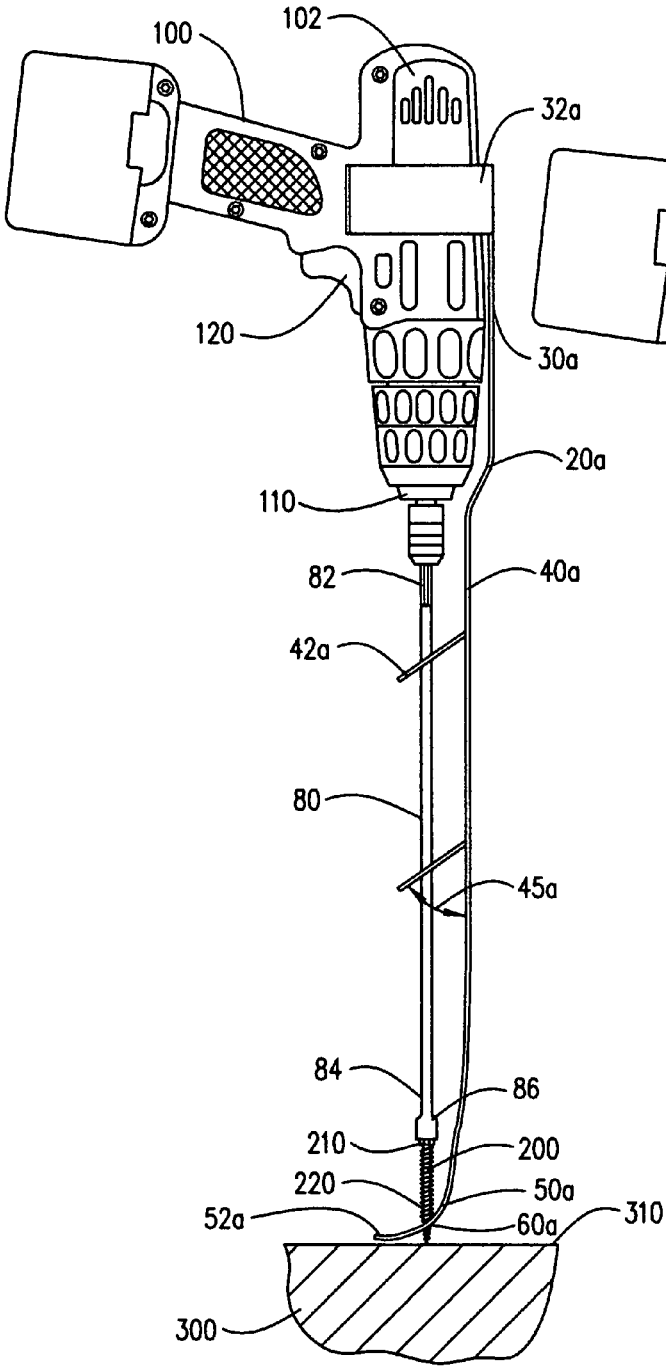
FIG. 1 is a side view of the first embodiment of the screw gun extension and screw keeper attached to a screw gun with the flexible descending curved portion in a position prior to the insertion of a screw into and object.
Figure 2:
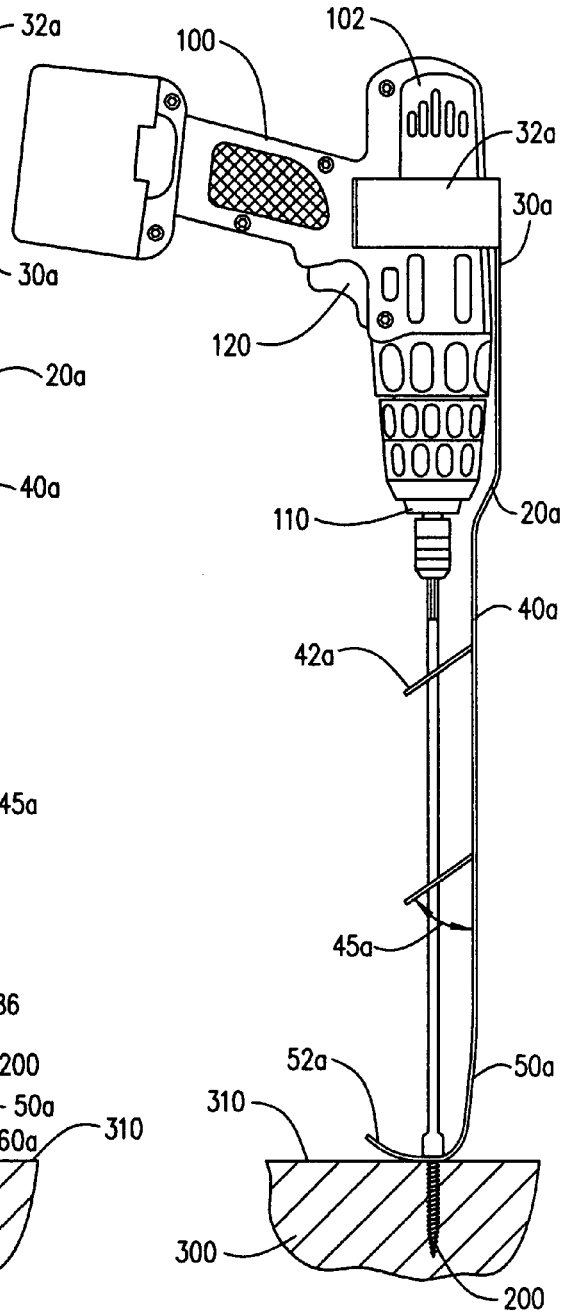
FIG. 2 is a side view of the first embodiment of the screw gun extension and screw keeper attached to a screw gun with the flexible descending curved portion in a position subsequent to the insertion of a screw into and object.

A screw gun extension and screw keeper 10 attaching to a screw gun 100, shown in FIGS. 1-7 of the drawings, extends the screw gun 100 and retains a screw 200 in a fixed position during the insertion of the screw. In a first embodiment, FIGS. 1, 2 and 5, the extension and screw keeper 10 comprises a rigid planar platform 20*a* having a first end 30*a* defining a resilient clamp member 32*a* removably securing to a frame 102 of the screw gun, an intermediate extension segment 40*a* and a second end 50*a* having a flexible descending curved portion 52*a* defining a tapered screw keeper channel 60*a*, adapted to receive and retain a threaded shaft 220 of the screw during initial insertion of the screw, the intermediate extension segment 40*a* presenting at least one descending bracket 42*a* having a central bore 46*a* within which a drill rod 80 is rotatably retained, the at least one descending bracket 42*a* directed from the planar platform in the same direction as the flexible descending curved portion 52*a* of the second end 50*a*, the drill rod 80 rotating within the central bore 46*a*, the drill rod 80 being attached within a compressible screw gun tip 110 of the screw gun at a first end 82 with the drill rod 80 having a screw head driver 86 at a second end 84, wherein a head 210 of the screw 200 is placed within the screw head driver 86 with the threaded shaft 220 of the screw 200 placed within the tapered screw keeper channel 60*a*, the flexible descending curved portion 52*a* of the second end 50*a* of the platform 20*a* flexibly withdrawn as the screw 200 is inserted into a surface 310 with the tapered screw keeper channel 60*a* releasing from the threaded shaft 220 of the screw 200 as the flexible descending curved portion 52*a* of the second end 50*a* is withdrawn allowing the head 210 of the screw 200 to pass through the tapered screw keeper channel 60*a*, providing the screw gun 100 to be operated from a greater distance from a surface 310 of an object 300 within which the screw 200 is to be inserted without requiring the screw to be held by hand. The tapered screw keeper channel 60*a* may be embodied as several removable section 62*a* held secure within a frame section 64*a* located on the second end 50*a* of the platform 20*a* which may be adapted to screws 200 of different diameters, FIG. 7.

In this first embodiment, the resilient clamp member 32*a* may be provided with a friction enhancing material 36*a* on an inner contact surface 34*a* to provide the clamp member 62*a* with an enhanced secure grasp upon the frame 102 of the screw gun 100 in a position on the frame 102 above a screw gun trigger 120, as shown in FIG. 5 of the drawings. Each of the at least one descending brackets 42*a* having the central bore 46*a* is provided at an acute forward angle 45*a* to prevent the extension and screw keeper 10 from sliding backwards during insertion of the screw 200, forcing the curved portion 52*a* and the second end 50*a* to retract out of the way of the pathway of the screw 200 without having the entire extension and screw keeper 10 moving during repeated insertion of multiple screws, FIGS. 1-2. It is contemplated within the scope of the first embodiment that an additional fastening means may be provided on the resilient clamp member to further attach the resilient clamp member to the frame of the screw gun, although not shown in the drawings. The entire extension and screw keeper 10 may be made from a singular stamped piece of material, including a sheet of spring steel, resilient aluminum, carbon steel, metal alloy or even a high density plastic, although plastics known to the industry at this time do not appear to be practical in a commercial application.

Figure 3:
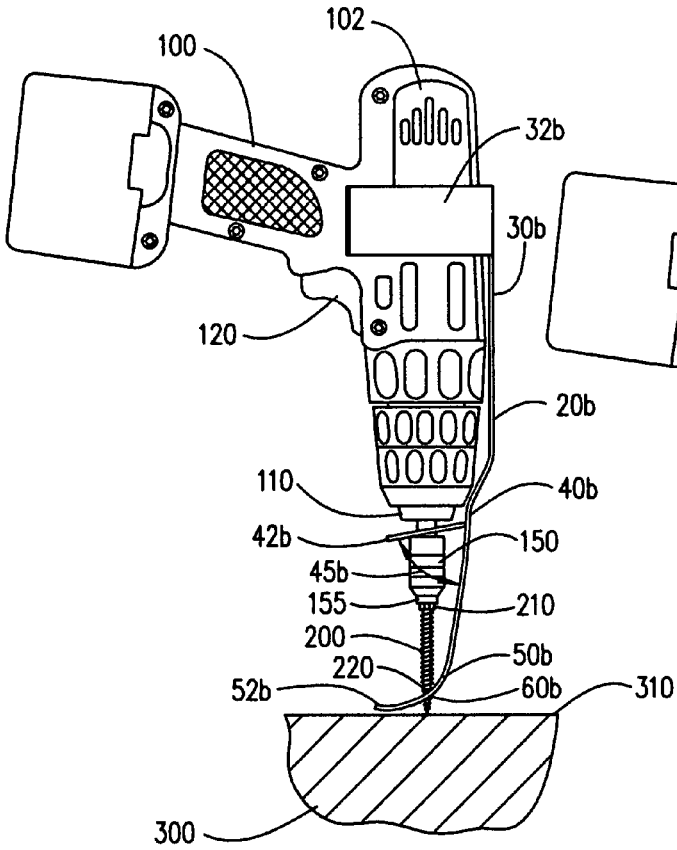
FIG. 3 is a side view of the second embodiment of the screw gun extension and screw keeper attached to a screw gun with the flexible descending curved portion in a position prior to the insertion of a screw into and object.
Figure 4:
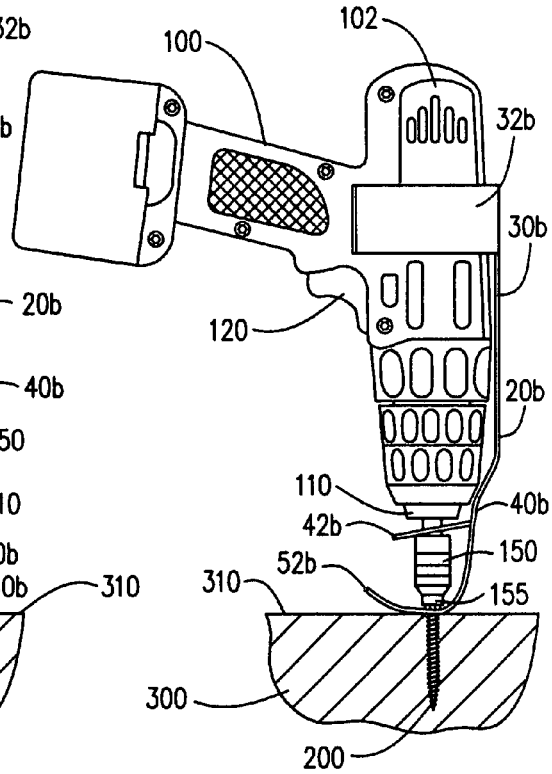
FIG. 4 is a side view of the second embodiment of the screw gun extension and screw keeper attached to a screw gun with the flexible descending curved portion in a position subsequent to the insertion of a screw into and object.

A second embodiment of the extension and screw keeper 10, FIGS. 3, 4 and 6, would be utilized for closer application of screw insertion and would also utilized a quick change bit adapter 150 installed in the compressible screw gun tip 110 of the screw gun 100, the second embodiment comprising a rigid planar platform 20*b* having a first end 30*b* defining a resilient clamp member 32*b* removably securing to a frame 102 of the screw gun 100, an intermediate extension segment 40*b* and a second end 50*b* having a flexible descending curved portion 52*b* defining a tapered screw keeper channel 60*b*, adapted to receive and retain a threaded shaft of a screw 220 during initial insertion of the screw, the intermediate extension section 40*b* presenting a descending bracket 42*b* having a central bore 46*b*, the descending bracket 42*b* directed from the planar platform 20*b* in the same direction as the flexible descending curved portion 52*b* of the second end 50*b*, the central bore 46*b* of the descending bracket 42*b* secured between the compressible screw gun tip 110 of the screw gun 100 upon the quick change bit adapter 150 installed within the compressible screw gun tip 110 with a screw driver bit 155 further installed within the quick change bit adapter 150 as is already disclosed in prior art, wherein a head 210 of the screw 200 is installed upon the screw driver bit 155 with the threaded shaft 220 of the screw 200 placed within the tapered screw keeper channel 60*b*, the flexible descending curved portion 52*b* of the second end 50*b* of the platform 20*b* flexibly withdrawn as the screw 200 is inserted into a surface 310, with the tapered screw keeper channel 60*b* releasing from the threaded shaft 220 of the screw 200 as the flexible descending curved portion 52*b* of the second end 50*b* is withdrawn allowing the head 210 of the screw 200 to pass through the tapered screw keeper channel 60*b* providing the screw gun 100 to be operated from an extended distance from the surface 310 of an object 300 within which the screw 200 is to be inserted without requiring the screw to be held by hand. The tapered screw keeper channel 60*b* may be embodied as a removable section 62*b* held secure within a frame section 64*b* located on the second end 50*b* of the platform 20*b* which may be adapted to screws of different diameters, FIG. 7.

In this second embodiment, the resilient clamp member 32*b* may be provided with a friction enhancing material 36*b* on an inner contact surface 34*b* to provide the clamp member 62*b* with an enhanced secure grasp upon the frame 102 of the screw gun 200 in a position on the frame 102 above a screw gun trigger 120, as shown in FIG. 6 of the drawings. The descending bracket 42*b* should extend from the resilient planar platform 20*b* at or near a right angle 45*b*, as indicated in FIG. 34 of the drawings, to provide the extension and screw keeper 10 in a fixed position upon the screw gun 100 with a little movement in the drilling direction as possible to install multiple screws 200 into an object 300 without having to constantly adjust and reposition the extension and screw keeper 10 upon the screw gun 100. It is contemplated within the scope of the second embodiment that an additional fastening means may be provided on the resilient clamp member to further attach the resilient clamp member to the frame of the screw gun, although not shown in the drawings. The entire extension and screw keeper 10 may be made from a singular stamped piece of material, including a sheet of spring steel, resilient aluminum, carbon steel, metal alloy or even a high density plastic, although plastics known to the industry at this time do not appear to be practical in a commercial application.

While the invention has been particularly shown and described with reference to a preferred embodiment thereof, it will be understood by those skilled in the art that changes in form and detail may be made therein without departing from the spirit and scope of the invention.

What is claimed is:

1. A screw gun extension and screw keeper attaching to and extending from a screw gun and retaining a screw in a fixed position during insertion of said screw into a surface of an object, said extension and screw keeper comprising:

a rigid planar platform having a first end defining a resilient clamp member removably securing to a frame of said screw gun, a second end having a flexible descending curved portion defining a tapered screw keeper channel providing a plurality of removable sections held secure within a frame section located on said second end of said platform, each of said plurality of removable sections adapted to screws of differing diameters, adapted to receive and retain a threaded shaft of a screw during an initial insertion of said screw, and an intermediary segment presenting at least one descending bracket having a central bore directed from said planar platform in a common direction as said flexible descending curved portion of said second end;

a drill rod rotatable retained within said central bore of said at least one descending bracket, said drill rod attached within a compressible screw gun tip of said screw gun at a first end with said drill rod defining a screw head driver at a second end, wherein a head of said screw is placed within said screw head driver with said threaded shaft of said screw placed within said tapered screw keeper channel, said flexible descending curved portion of said second end of said platform flexibly withdrawn as said screw is inserted into said object with said tapered screw keeper channel releasing from said threaded shaft of said screw as said flexible descending curved portion of said second end is withdrawn, allowing said head of said screw to pass through said tapered screw keeper channel for full insertion of said screw into said object, providing said screw gun to be operable from a greater distance from said surface of said object within which said screw is inserted without requiring said screw to be held by hand.

2. The extension and screw keeper as disclosed in claim 1, further comprising:

said resilient clamp member having a friction enhancing material on an inner contact surface providing said clamp member with an enhanced secure grasp upon said frame of said screw gun; and each of said at least one descending bracket having said central bore is provided at an acute forward angle from said intermediate extension segment of said rigid planar platform, restricting said extension and screw keeper from rear movement during insertion of said screw by said drill rod, further forcing said flexible descending curved portion to retract out of the way of the pathway of the screw without movement of said extension and screw keeper during repeated insertion of multiple screws.

3. A screw gun extension and screw keeper attaching to and extending from a screw gun and retaining a screw in a fixed position during insertion of said screw into a surface of an object, said screw gun also providing a quick change bit adapter which installs within a compressible screw gun tip of said screw gun, said extension and screw keeper comprising:

a rigid planar platform having a first end defining a resilient clamp member removably securing to a frame of the screw gun, a second end having a flexible descending curved portion defining a tapered screw keeper channel providing a plurality of removable sections held secure within a frame section located on said second end of said platform, each of said plurality of removable sections adapted to screws of differing diameters, adapted to receive and retain a threaded shaft of a screw during initial insertion of said screw, and an intermediate extension segment having a descending bracket having a central bore, said descending bracket directed from said planar platform in a common direction as said flexible descending curved portion of said second end, said central bore of said descending bracket secured between said compressible screw gun tip of said screw gun and said quick change bit adapter installed within said compressible screw gun tip, additionally providing a screw driver bit further installed within said quick change bit adapter, wherein a head of said screw is placed upon said screw driver bit with said threaded shaft of said screw placed within said tapered screw keeper channel, said flexible descending curved portion of said second end of said platform flexibly withdrawn as said screw is inserted into said surface of said object with said tapered screw keeper channel releasing from said threaded shaft of said screw as said flexible descending curved portion of said second end is withdrawn, allowing said head of said screw to pass through said tapered screw keeper channel for full insertion of said screw into said object, providing said screw gun to be operable from a greater distance from said surface of said object within which said screw is inserted without requiring said screw to be held by hand.

4. The extension and screw keeper as disclosed in claim 3, further comprising:

said resilient clamp member having a friction enhancing material on an inner contact surface providing said clamp member with an enhanced secure grasp upon said frame of said screw gun; and said descending bracket extending from said resilient planar platform at or near a right angle providing said extension and screw keeper in a fixed position upon said screw gun without movement while installing multiple screws into an object without requiring adjustment and repositioning of said extension and screw keeper upon said screw gun.

* * * * *